United States Patent [19]

Tsuruta

[11] Patent Number: 4,945,871

[45] Date of Patent: Aug. 7, 1990

[54] HYDRAULIC VALVE LIFTER FOR INTERNAL COMBUSTION ENGINE

[75] Inventor: Seiji Tsuruta, Kanagawa, Japan

[73] Assignee: Atsugi Motor Parts Company, Limited, Kanagawa, Japan

[21] Appl. No.: 357,005

[22] Filed: May 27, 1989

[30] Foreign Application Priority Data

May 27, 1988 [JP] Japan ..... 63-69943[U]

[51] Int. Cl.[5] ..... F01L 1/14; F01L 1/24

[52] U.S. Cl. ..... 123/90.55; 123/90.52

[58] Field of Search ..... 123/90.55, 90.52, 90.48

[56] References Cited

U.S. PATENT DOCUMENTS 4,688,525 8/1987 Nakamura ..... 123/90.55

4,756,282 7/1988 Kunz et al. ..... 123/90.55

4,793,295 12/1988 Downing ..... 123/90.55

4,802,448 2/1989 Ableitner ..... 123/90.55

*Primary Examiner*—David A. Okonsky

*Assistant Examiner*—Weilun Lo

*Attorney, Agent, or Firm*—Bachman & LaPointe

[57] ABSTRACT

A valve lifter employs a plunger head to be coupled with a seat plunger. The plunger head is provided an upper end surface mating with a surface of an upper end wall of a lifter body so that the upper surface may establish face contact with the mating surface of the upper end wall. The plunger head is so designed as to define a communication path for establishing fluid communication between a fluid supply path to a fluid reservoir defined in the seat plunger and another communication path for establishing fluid communication between the fluid supply path to a drainage formed through the upper end wall of the lifter body.

16 Claims, 3 Drawing Sheets

HYDRAULIC VALVE LIFTER FOR INTERNAL COMBUSTION ENGINE

BACKGROUND OF THE INVENTION

1. Field of the Invention

The present invention relates generally to a hydraulic valve lifter for an internal combustion engine for adjusting valve clearance of intake and exhaust valve.

2. Description of the Background Art

Japanese Utility Model First (unexamined) Publication (Jikkai) Showa No. 60-49206 discloses one of typical construction of valve lifter which forms background art of the present invention. The valve lifter comprises a hollow lifter body and a plunger assembly housed within the lifter body. The plunger assembly comprises an upper side opened and essentially cylindrical plunger body and a seat plunger disposed within the plunger body in mutually thrusting fashion. The plunger body and the seat plunger are cooperated with each other for defining a high pressure chamber therebetween. The seat plunger is formed with a hollow chamber serving as a reservoir chamber which communicates with the high pressure chamber via a check valve assembly for compensating working fluid pressure in the high pressure chamber.

The seat plunger has upper end mating with upper end wall of the lifter body, which upper end wall is formed with a through opening for draining part of the working fluid and ventilating air fed with the working fluid. In order to adjust working fluid flow rate, a metering ring plate is provided in opposition to the mating end of the through opening. The metering ring plate has an arcuated section opposing to the inner end of the through opening in spaced apart relationship for defining therebetween a clearance for permitting part of the working fluid and air to flow through the through opening.

In order to supply the working fluid to the reservoir chamber of the seat plunger, an annular fluid path is formed around the upper end of the seat plunger, which annular path is connected to a pressurized working fluid source. The annular path is in communication with the reservoir chamber via radial path including cut outs formed through the upper end portion of the seat plunger.

With the conventional valve lifter construction, the seat plunger contacts the inner surface of the upper end wall at the annular end surface which is discontinued by the cut out. To this contacting surface, substantially high pressure is repeatedly exerted while the engine is driven via a valve stem of the associated intake valve or exhaust valve. Therefore, the upper end edge of the seat plunger may cause wearing due to repeated exertion of substantial pressure. Since the clearance between the metering plate and the inner end of the through opening is maintained by the height of the upper edge of the seat plunger, wearing of the upper edge of the seat plunger may cause reduction of the clearance.

Reduction of the clearance may cause degradation of air ventilating performance to cause the air to flow into the high pressure chamber. Air in the high pressure chamber may cause instability of the valve action resulting in instability of the engine operation. In the worst case, the metering ring plate may completely close the inner end of the through opening to cause accumulation of the air in the reservoir chamber to prevent the working fluid from entering into the reservoir chamber. This results in lack of pressure in the high pressure chamber for causing incapability of valve clearance adjustment.

SUMMARY OF THE INVENTION

Therefore, it is an object of the present invention is to provide a valve lifter which is free from the problem set for above and can maintain valve clearance adjusting ability for a long period.

In order to accomplish aforementioned and other objects, a valve lifter, according to the present invention, employs a plunger head to be coupled with a seat plunger. The plunger head is provided an upper end surface mating with a surface of an upper end wall of a lifter body so that the upper surface may establish face contact with the mating surface of the upper end wall. The plunger head is so designed as to define a communication path for establishing fluid communication between a fluid supply path to a fluid reservoir defined in the seat plunger and another communication path for establishing fluid communication between the fluid supply path to a drainage formed through the upper end wall of the lifter body.

According to one aspect of the invention, a valve lifter for an internal combustion engine for automatically and hydraulically adjusting valve clearance of one of an intake valve and an exhaust valve, comprises:

an generally cylindrical lifter body having an upper end wall defining a through drainage opening;

a plunger assembly including mutually and axially movable first and second cylindrical plunger members, said first and second cylindrical plunger members defining a high pressure chamber for generating a hydraulic force for exerting adjusting force for associated one of said intake and exhaust valves via said first plunger member, and a fluid reservoir chamber, said plunger assembly defining an annular fluid chamber communicating with a pressurized fluid source via a fluid path, and said second plunger member having a planner surface mating with the lower surface of said upper end wall for establishing face contact to each other;

first means for defining a first communication path for establishing fluid communication between annular chamber and said fluid reservoir chamber with a limited fluid flow rate; and second means for defining a second communication path extending on said planner surface for establishing fluid communication between said annular chamber and said drainage opening for draining excessive working fluid together with an air contained in the working fluid.

The valve lifter may further comprise third means for establishing fluid communication between said fluid reservoir chamber and said second communication path. The annular chamber may be so designed as to decelerate flow velocity of said working fluid for causing separation of the working fluid and the air for ventilating the air through said drainage opening via said second communication path. The first plunger member may comprise a first cylindrical member with a bottom closure end for defining an internal space, and a second plunger member comprising a second cylindrical member with a bottom wall with a center opening, and a top closure member fitted onto the top end of said second cylindrical member and having said planner surface to mate with the inner surface of said upper end wall of said lifter body, said second plunger member defining said high pressure chamber between said bottom wall and said bottom closure end of said first plunger member and said fluid reservoir therein, said high pressure chamber being in communication with said fluid reservoir chamber via a check valve. The top closure member has an extension strip engaging with said second cylindrical member. The second means comprises a radially extending groove formed upon the upper surface of said top closure member.

The first means comprises a cut-out formed in said top closure member, which cut-out has one end opening toward said annular chamber and the other end opening to said fluid reservoir chamber. The top end closure member comprises an essentially disc shaped main body fitted on the upper end of said second cylindrical member with an axially extending cylindrical wall section, and an extension extending strip extending laterally from the lower end of said cylindrical wall section for engaging with said second cylindrical member. The cylindrical wall may have an external diameter for firm engagement with the inner periphery of the second cylindrical member. In the alternative, the cylindrical wall may have an external diameter smaller than the internal diameter of the second cylindrical member so as define therebetween a clearance serving as a part of said first communication path.

According to another aspect of the invention, a valve lifter for an internal combustion engine for automatically and hydraulically adjusting valve clearance of one of an intake valve and an exhaust valve, comprises:

a generally cylindrical lifter body having an upper end wall defining a through drainage opening;

a plunger assembly including mutually and axially movable first and second cylindrical plunger members, said first and second cylindrical plunger members defining a high pressure chamber for generating a hydraulic force for exerting adjusting force for associated one of said intake and exhaust valves via said first plunger member, and a fluid reservoir chamber, said plunger assembly defining an annular fluid chamber communicated with a pressurized fluid source via a fluid path, and said second plunger member having a planner surface mating with the lower surface of said upper end wall for establishing face contact to each other;

a engine lubricant supply means for introducing the engine lubricant from said fluid path into said annular chamber in such a manner that flow velocity of said engine lubricant in said annular chamber causes deceleration to cause separation of air from the engine lubricant a first communication path means for establishing fluid communication between annular chamber and said fluid reservoir chamber with a limited fluid flow rate; and a second communication path means, extending on said planner surface for establishing fluid communication between said annular chamber and said drainage opening, for draining excessive engine lubricant together with an air contained in the engine lubricant.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
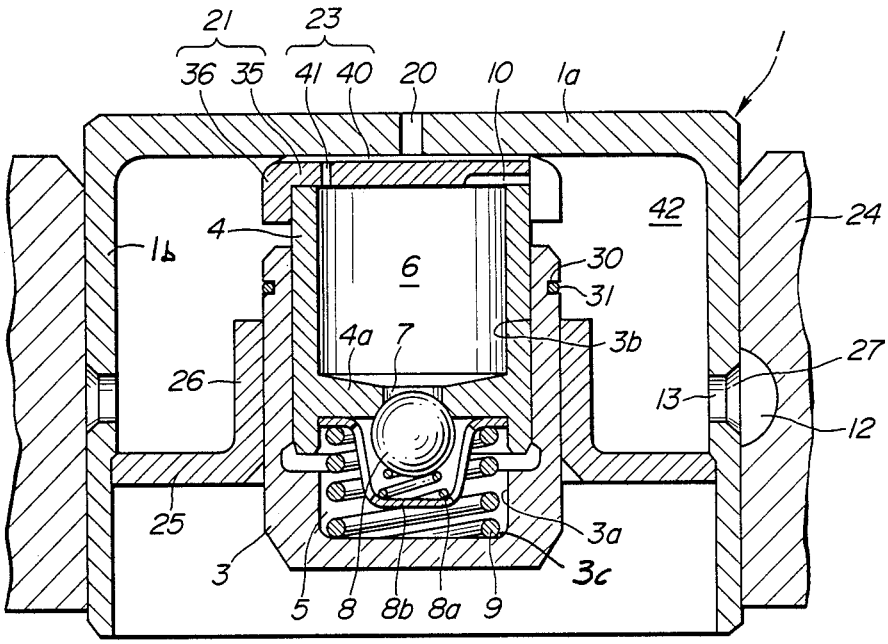
FIG. 1 is a section of the first embodiment of a valve lifter according to the present invention.
Figure 2:
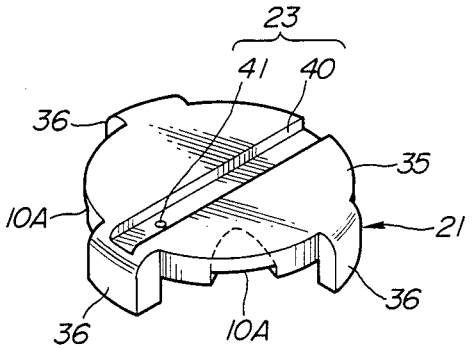
FIG. 2 is a plunger head employed in the first embodiment of the valve lifter of FIG. 1.

Referring now to the drawings, particularly to FIGS. 1 and 2, the first embodiment of a valve lifter, according to the present invention, comprises a lifter body 1 of generally upper end closed cylindrical construction. The lifter body 1 has cylindrical side wall 1*b* and an upper end wall 1*a* extending in transverse to the cylindrical side wall and closing the upper end thereof. The lifter body 1 is received in a valve lifter receptacle 24 formed in a cylinder head and/or rocker arm directing lower end opening to a valve stem (not shown) of intake or exhaust valve.

A plunger 3 is received within the internal space of the lifter body 1 and thrustingly supported by means of a cylindrical extension 26 of an annular partitioning wall 25 extending from the inner periphery of the lifter body. The plunger 3 is formed into a lower end closed cylindrical constriction having external diameter substantially equal to the internal diameter of the cylindrical section 26 of the partitioning wall 25. The plunger 3 defines therein a bore including a smaller diameter bore section 3*a* and a larger diameter bore section 3*b*. As seen from FIG. 1, the smaller diameter bore section 3*a* is defined in the vicinity of a lower end wall 3*c* of the plunger 3. A seat plunger 4 is disposed within the larger diameter bore section 3*b* of the plunger 3 in a manner permitting relative thrusting movement to each other. The seat plunger 4 is provided with a lower end wall 4*a* with an axially extending center opening 7. With the lower end wall 4*a*, a high pressure chamber 5 is defined within the smaller diameter bore section 3*a*. The high pressure chamber 5 is in communication with the internal space of the seat plunger 4, which internal space serves as a reservoir chamber, via the center opening 7 of the lower end wall 4*a*.

A ball shaped check valve 8 is associated with the center opening 7. The check valve 8 is cooperated with a valve spring 8*a* which is seated on a retainer 8*b*. The retainer 8*b* is biased toward the lower end wall 4*a* of the seat plunger 4 by means of a spring 9. The spring 9 is so designed as to serve as a return spring for normally biasing the plunger 3 and the seat plunger 4 in directions to move away from each other.

The upper end of the seat plunger 4 is closed by a plunger head 21. As seen from FIG. 2, the plunger head 21 has a main body 35 which is formed into essentially disc shaped configuration, and axially extending claws 36 to engage with the outer circumference of the seat plunger 4. With these claws 36, the plunger head 21 is fitted onto the upper end of the seat plunger 4. The plunger head 21 is also formed with a radially extending groove 40 formed on the upper surface of the main body 35 of the plunger head 21. The groove 40 communicates with the reservoir chamber 6 defined within the seat plunger 4 via a through opening 41. The plunger head 21 is further formed with cut outs 10 opening at the circumferential edge of the main body 35 of the plunger head 21.

The assembly of the plunger 3 and the seat plunger 4 is disposed within the lifter body 1 to define therein an annular chamber 42. The annular chamber 42 communicates with an oil gallery 12 via a fluid path opening 13 formed through the lifter body 1. The lifter body 1 is also formed with a drainage opening 20 which is in communication with the groove 40.

In the shown embodiment, the engine lubricant is utilized as working fluid. The engine lubricant is circulated through a known engine lubricant path around the engine cylinder and flows through the oil gallery 12. The engine lubricant is circulated with air. The engine lubricant flowing through the oil gallery 12 flows into the annular chamber 42 via the fluid path opening 13. Part of the engine lubricant and the air which has a smaller specific gravity than the lubricant, flowing into the annular chamber 42 are forced to the radial groove 40 and drained through the drainage opening 20. The remaining part from which the air is removed, is introduced into the reservoir chamber 6 via the cut-outs 10.

As can be seen from FIG. 1, the annular chamber 42 has relatively large volume in comparison with the amount of fluid to be introduced into the reservoir chamber 6. The larger volume of the annular chamber 42 may be effective for decelerating the flow velocity of the engine lubricant flowing thereinto via the fluid path opening 13. Lower flow velocity may cause separation of the lubricant and air for the smaller specific gravity of the air in comparison with the lubricant. Furthermore, deceleration of the lubricant flow velocity and larger volume of the annular chamber prolongates a period in which the engine lubricant and the air are introduced from the oil gallery 12. This is effective for separating the engine lubricant and the air. Therefore, air can be effectively removed from the engine lubricant. This assures removal of the air from the engine lubricant to be introduced into the reservoir chamber 6. Furthermore, since the cut-outs 10 serve for restricting the working fluid flowing into the reservoir chamber 6. The engine lubricant flow is decelerated in the reservoir chamber 6. This is also effective for separating the air from the engine lubricant. Since the reservoir chamber 6 of the seat plunger 4 communicates with the groove 40 via the through opening 41, even when the air is introduced into the reservoir chamber 6, it can be successfully vented to the groove 40 via the through opening 41.

During the engine operation, the plunger 3 is shifted in the axial direction according to the engine revolution cycle relative to the seat plunger 4. With the thrusting movement, the plunger 3 for which the force of the return spring 9 and the working fluid pressure in the high pressure chamber 5, serves for adjusting valve clearance. The stroke of motion of the plunger 3 is limited by a stopper ring 31 which is engaged in the vicinity of the upper end of the plunger and is designed to contact the cylindrical section 26 of the partitioning member 25 for defining the limit of the downward motion of the plunger 3. On the other hand, at the end of the upward motion, the shoulder between the smaller diameter bore section **3*a* and the larger diameter bore section 3*b* contacts with the lower end of the seat plunger 4 to be prevented from shifting further upwardly. In this operation, when the fluid pressure in the high pressure chamber 5 becomes smaller than a predetermined level, the lubricant pressure in the reservoir chamber 6 overcomes the spring force of the valve spring 8*a* to open the communication path 7 to permit the engine lubricant to flow into the high pressure chamber 5. Therefore, the lubricant pressure in the high pressure chamber 5** can be maintained substantially constant.

During the engine operation, the seat plunger 4 is repeatedly subject to depressing force to depress the upper end toward the upper end wall l*a* of the lifter body 1, which depressing force is generally of a combined force of a spring force of valve spring associated with valve, i.e. intake valve or exhaust valve, a spring force of the return spring 9 and the fluid force in the high pressure chamber 5. However, in the shown embodiment, since the annular upper end of the seat plunger 4 is covered by the plunger head 21, direct contact between the seat plunger 4 and the lifter body 1 is avoided. Since the upper surface of the plunger head 21, where the plunger head contacts with the inner or lower surface of the end wall **1*a* of the lifter body 1, is formed into an essentially flat surface establishing face contact with the essentially flat inner surface of the end wall, substantial wearing can be successfully prevented. Furthermore, since the ventilation of the air and drainage of the excessive lubricant can be done through the groove 40 formed on the upper surface of the plunger head 21**, the performance of drainage can be maintained for extremely long periods. Therefore, the life of the valve lifter can be remarkably extended.

Figure 3:
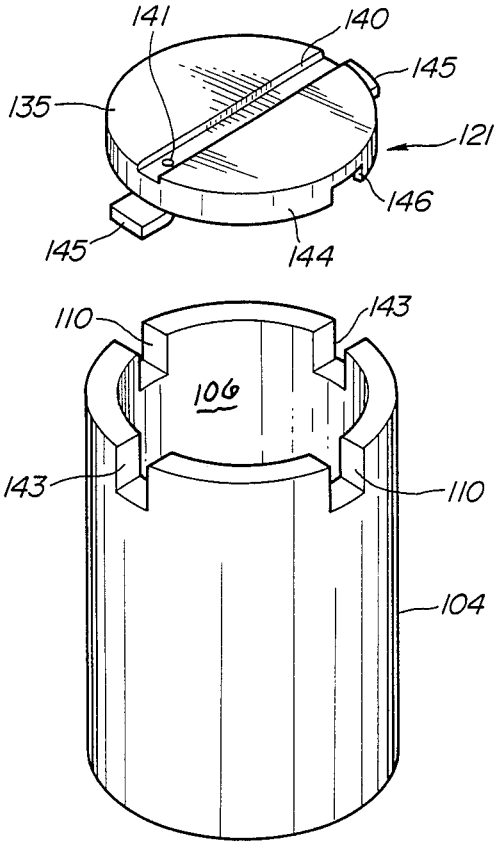
FIG. 3 is a section of the second embodiment of a valve lifter according to the present invention.
Figure 4:
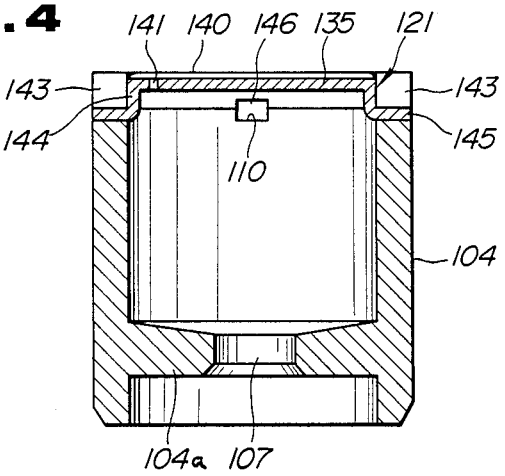
FIG. 4 is a plunger head employed in the second embodiment of the valve lifter of FIG. 3.

FIGS. 3 and 4 shows the second embodiment of the valve lifter according to the present invention. Since the shown embodiment is differentiated from the former embodiment in the construction of the seat plunger 4 and the plunger head 21, FIGS. 3 and 4 illustrates only seat plunger and the plunger head.

In the shown embodiment, the seat plunger 104 has the lower end wall **104*a* with a center opening 107 similar to the foregoing embodiment. The seat plunger 104 is also formed with a plurality of cut-outs 143 on the upper circumferential edge. The cut-outs 143 are arranged in radially symmetrical orientation to each other. In the shown embodiment, four cut-outs 143** are formed with equal angular intervals.

A plunger head 121 has a generally disc shaped main body 135 with a vertically and downwardly extending circumferential wall section 144. The external diameter of the circumferential wall section 144 is substantially equal to the internal diameter of the seat plunger 104 for establishing liquid tight engagement therebetween. Engaging claws 145 are extended from the lower edge of the circumferential wall section 144. These engaging claws 145 are formed in radially symmetrical orientation. In the shown embodiment, plunger head 121 is provided two engaging claws 145. These engaging claws 145 engage with two of four cut-outs 143 of the seat plunger 104. These engaging claws establish firm engagement between the seat plunger 104 and the plunger head 121. The height of the circumferential wall 144 and the engaging claws 145 may be determined so that the upper surface of the main body 135 lies flush with the upper edge of the seat plunger 104 for forming a flat plane. The plunger head 121 is formed with a radially extending groove 140 with a through opening 141 axially extending to establish communication between the groove 140 and the reservoir chamber 106 defined in the seat plunger 104. The plunger head 121 is further formed with cut-outs 146. The upper edge of each cut-out 146 is positioned at the same elevation to the lower surface of the disc shaped main body 135 of the plunger head 121. The cut-outs 146 are formed in orientations angularly offset from the orientation of the engaging claws 145 in right angle and adapted to cooperate with cut-outs 143 to which the engaging claw is not engaged for defining a fluid path 110 for introducing the working fluid into reservoir chamber 106.

With the construction set forth above, substantially the same effect of air removal from the engine lubricant and prolongation of the life of the valve lifter can be achieved as that achieved by the former embodiment.

Figure 5:
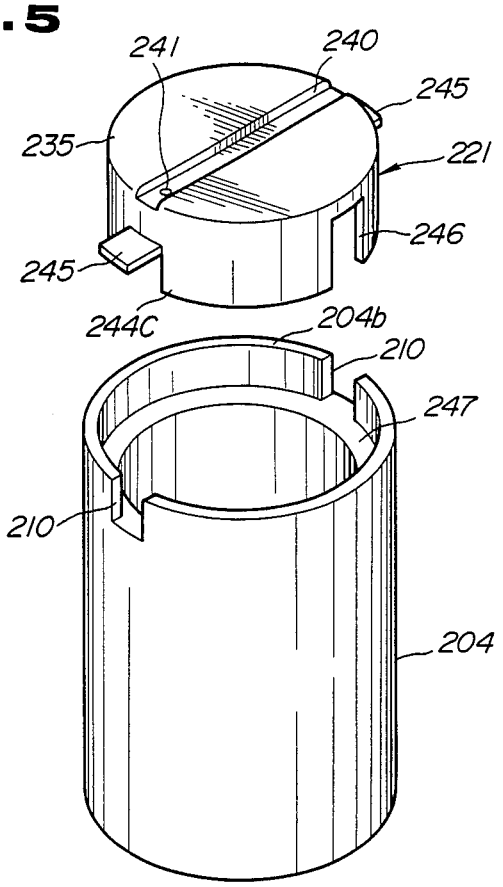
FIG. 5 is a section of the third embodiment of a valve lifter according to the present invention.
Figure 6:
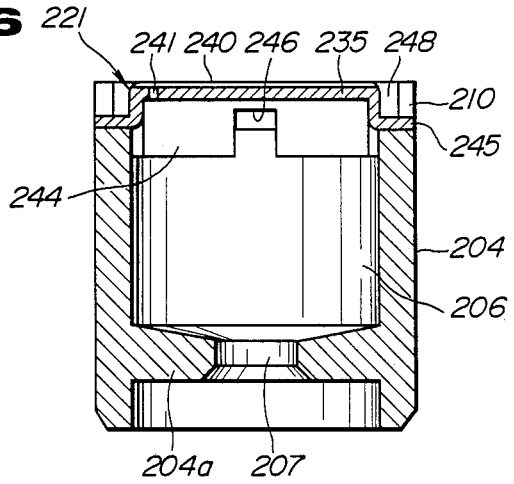
FIG. 6 is a plunger head employed in the third embodiment of the valve lifter of FIG. 5.

FIGS. 5 and 6 shows the third embodiment of the valve lifter according to the present invention. In this embodiment, only the seat plunger and the plunger head are differentiated from the first embodiment of the valve lifter. Therefore, FIGS. 5 and 6 show only the seat plunger 204 and the plunger head 221. Similarly to the former embodiments, the seat plunger 204 of this embodiment is formed with a lower end wall **204*a* with a center opening 207. The upper end of the seat plunger 204 has thin wall section 204*b* with a stepped shoulder 247 which extends circumferentially along the inner peripheral edge of the major section of the seat plunger. The thin wall section 204*b* is formed with a pair of cut-outs 210** which are arranged in diameterically symmetrical relationship to each other.

A plunger head 221 has a generally disc shaped main body 235 with a vertically and downwardly extending circumferential wall section 244. The external diameter of the circumferential wall section 244 is smaller than the internal diameter of the seat plunger 204 for defining therebetween a clearance 248. Engaging claws 245 are extended from the lower edge of the circumferential wall section 244. These engaging claws 245 are formed in radially symmetrical orientation. In the shown embodiment, plunger head 221 is provided two engaging claws 245. These engaging claws 245 engage with the cut-outs 210 of the seat plunger 204. These engaging claws 245 establish firm engagement between the seat plunger 204 and the plunger head 221. The height of the circumferential wall 244 and the engaging claws 245 may be determined so that the upper surface of the main body 235 lies flush with the upper edge of the seat plunger 204 for forming a flat plane. In the alternative, it may be possible to design the circumferential wall 244 to be longer than the thin wall section **204*b* so that the upper surface of the main body 235 of the plunger head 221** to be upwardly extended from the upper end of the seat plunger.

The plunger head 221 is formed with a radially extending groove 240 with a through opening 241 axially extending to establish communication between the groove 240 and the reservoir chamber 206 defined in the seat plunger 204. The plunger head 221 is further formed with cut-outs 246. The upper edge of each cut-out 246 is positioned at the same elevation to the lower surface of the disc shaped main body 235 of the plunger head 221. The cut-outs 246 are formed in orientations angularly offset from the orientation of the engaging claws 245 in right angle and adapted to cooperate with cut-outs 243 to which the engaging claw is not engaged for defining a fluid path for introducing the working fluid into reservoir chamber 206 via the clearance 248.

This embodiment also realize the advantages obtained from the first embodiment of the valve lifter according to the present invention.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A valve lifter for an internal combustion engine for automatically and hydraulically adjusting valve clearance of one of an intake valve and an exhaust valve, comprising:

a generally cylindrical lifter body having an upper end wall defining a through drainage opening;

a plunger assembly including mutually and axially movable first and second cylindrical plunger members, said first and second cylindrical plunger members defining a high pressure chamber for generating a hydraulic force for exerting adjusting force for associated one of said intake and exhaust valves via said first plunger member, and a fluid reservoir chamber, said plunger assembly defining an annular fluid chamber communicating with a pressurized fluid source via a fluid path;

a top closure member providing in firm engagement with said second plunger member and having a top surface mating with said upper end wall for establishing face contact, wherein said top closure member comprises an essentially disc shaped main body fitted on the upper end of said second plunger member with an axially extending cylindrical wall section, and an extension extending strip extending laterally from the lower end of said cylindrical wall section for engaging with said second plunger member;

first means, associated with said second plunger member and said top closure member, for defining a first communication path for establishing fluid communication between the annular chamber and said fluid reservoir chamber with a limited fluid flow rate; and second means for defining a second communication path extending on a planar surface for establishing fluid communication between said annular chamber and said drainage opening for draining excessive working fluid together with an air contained in the working fluid.

2. A valve lifter as set forth in claim 1, which further comprises third means for establishing fluid communication between said fluid reservoir chamber and said second communication path.

3. A valve lifter as set forth in claim 1, wherein said annular chamber is so designed as to decelerate flow velocity of said working fluid for causing separation of the working fluid and the air for ventilating the air through said drainage opening via said second communication path.

4. A valve lifter as set forth in claim 1, wherein said first plunger member comprises a first cylindrical member with a bottom closure end for defining an internal space, and a second plunger member comprising a second cylindrical member with a bottom wall with a center opening, and said top closure member fitted onto the top end of said second cylindrical member and having a planar surface to mate with the inner surface of said upper end wall of said lifter body, said second plunger member defining said high pressure chamber between said bottom wall and said bottom closure end of said first plunger member and said fluid reservoir therein, said high pressure chamber being in communication with said fluid reservoir chamber via a check valve.

5. A valve lifter as set forth in claim 1, wherein said cylindrical wall has an external diameter for firm engagement with the inner periphery of the second cylindrical member.

6. A valve lifter as set forth in claim 4, wherein said second means comprises a radially extending groove formed upon the upper surface of said top closure member.

7. A valve lifter as set forth in claim 4, wherein said first means comprises a cut-out formed in said top closure member, which cut-out has one end opening toward said annular chamber and the other end opening to said fluid reservoir chamber.

8. A valve lifter as set forth in claim 1, wherein said cylindrical wall has an external diameter smaller than the internal diameter of the second cylindrical member so as define therebetween a clearance serving as a part of said first communication path.

9. A valve lifter for an internal combustion engine for automatically and hydraulically adjusting valve clearance of one of an intake valve and an exhaust valve, comprising:

a generally cylindrical lifter body having an upper end wall defining a through drainage opening;

a plunger assembly including mutually and axially movable first and second cylindrical plunger members, said first and second cylindrical plunger members defining a high pressure chamber for generating a hydraulic force for exerting adjusting force for associated one of said intake and exhaust valves via said first plunger member, and a fluid reservoir chamber, said plunger assembly defining an annular fluid chamber communicating with a pressurized fluid source via a fluid path;

a top closure member providing in firm engagement with said second plunger member and having a top surface mating with said upper end wall for establishing face contact, wherein said top closure member comprises an essentially disc shaped main body fitted on the upper end of said second plunger member with an axially extending cylindrical wall section, and an extension extending strip extending laterally from the lower end of said cylindrical wall section for engaging with said second plunger member;

an engine lubricant supply means for introducing the engine lubricant from said fluid path into said annular chamber in such a manner that flow velocity of said engine lubricant in said annular chamber causes deceleration to cause separation of air from the engine lubricant;

a first communication path means associated with said second plunger member and said top closure member for establishing fluid communication between the annular chamber and said fluid reservoir chamber with a limited fluid flow rate; and a second communication path means, extending on a planar surface for establishing fluid communication between said annular chamber and said drainage opening, for draining excessive engine lubricant together with an air contained in the engine lubricant.

10. A valve lifter as set forth in claim 9, wherein said cylindrical wall has an external diameter for firm engagement with the inner periphery of the second cylindrical member.

11. A valve lifter as set forth in claim 9, wherein said cylindrical wall has an external diameter smaller than the internal diameter of the second cylindrical member so as define therebetween a clearance serving as a part of said first communication path.

12. A valve lifter as set forth in claim 9, which further comprises third communication path means for establishing fluid communication between said fluid reservoir chamber and said second communication path means.

13. A valve lifter as set forth in claim 9, wherein said annular chamber is so designed as to decelerate flow velocity of said engine lubricant for causing separation of the engine lubricant and the air for ventilating the air through said drainage opening via said second communication path.

14. A valve lifter as set forth in claim 9, wherein said first plunger member comprises a first cylindrical member with a bottom closure end for defining an internal space, and a second plunger member comprising a second cylindrical member with a bottom wall with a center opening, and said top closure member fitted onto the top end of second cylindrical member and having said planar surface to mate with the inner surface of said upper end wall of said lifter body, said second plunger member defining said high pressure chamber between said bottom wall and said bottom closure end of said first plunger member and said fluid reservoir therein, said high pressure chamber being in communication with said fluid reservoir chamber via a check valve.

15. A valve lifter as set forth in claim 14, wherein said first communication path means comprises a cut-out formed in said top closure member, which cut-out has one end opening toward said annular chamber and the other end opening to said fluid reservoir chamber.

16. A valve lifter as set forth in claim 14, wherein said second means comprises a radially extending groove formed upon the upper surface of said top closure member.

* * * * *